US012662832B2

(12) United States Patent
Larson et al.

(10) Patent No.: US 12,662,832 B2
(45) Date of Patent: Jun. 23, 2026

(54) OUTDOOR SOAKING TUB

(71) Applicant: Larson Design, LLC, Pembroke, NH (US)

(72) Inventors: Karen C. Larson, Pembroke, NH (US); Brian P. Larson, Pembroke, NH (US)

(73) Assignee: Larson Design, LLC, Pembroke, NH (US)

( * ) Notice: Subject to any disclaimer, the term of this patent is extended or adjusted under 35 U.S.C. 154(b) by 0 days.

(21) Appl. No.: 18/610,534

(22) Filed: Mar. 20, 2024

(65) Prior Publication Data

US 2025/0092704 A1 Mar. 20, 2025

Related U.S. Application Data

(60) Provisional application No. 63/453,278, filed on Mar. 20, 2023.

(51) Int. Cl.
*E04H 4/00* (2006.01)
*E04H 4/14* (2006.01)

(52) U.S. Cl.
CPC ..... *E04H 4/0093* (2013.01); *E04H 4/148* (2013.01)

(58) Field of Classification Search
CPC ..... E04H 4/0093
USPC ..... D23/277
See application file for complete search history.

(56) References Cited

U.S. PATENT DOCUMENTS

| | | | | | |
|---|---|---|---|---|---|
| 2,464,645 | A * | 3/1949 | Lassa | E03C 1/232 | 4/584 |
| 4,189,887 | A * | 2/1980 | Gallant | E04H 4/141 | 52/311.1 |
| D703,795 | S * | 4/2014 | Licini | D23/277 | |
| 10,478,377 | B1 * | 11/2019 | Selinger | A61H 33/6005 | |
| D976,372 | S * | 1/2023 | Haraldsson | D23/277 | |
| D1,001,982 | S * | 10/2023 | Adams | D23/277 | |

* cited by examiner

*Primary Examiner* — Christine J Skubinna
(74) *Attorney, Agent, or Firm* — Hinckley Allen & Snyder

(57) ABSTRACT

An outdoor soaking tub that is preferably precast, out of concrete, and designed to have a tiled interior, a pillow or cushion attachment point as well as hidden electrical connections for a light and a ground bonding wire and plumbing conduit for heated or jetted water.

1 Claim, 3 Drawing Sheets

OUTDOOR SOAKING TUB

CROSS-REFERENCE TO RELATED APPLICATIONS

This application claims priority from U.S. Provisional Patent application No. 63/453,278 filed Mar. 20, 2023 titled Outdoor soaking Tub, which application is fully incorporated herein by reference.

TECHNICAL FIELD

The present invention relates to soaking tubs, and more particularly to a precast concrete tub designed to be placed and used outdoors in a garden or similar type setting.

BACKGROUND INFORMATION

Although swimming pools and hot tubs as well as outdoor showers are well known, swimming pools and hot tubs require significant maintenance as well as plumbing and electrical set up. Individuals desire a mental vacation that an outdoor tub provides without the size and maintenance of either swimming pool or hot tub. Accordingly, a need exists for a soaking type tub for use outdoors such as in a garden, or other outdoor setting.

SUMMARY OF THE INVENTION

The invention features a pre-cast concrete outdoor garden tub comprising a precast concrete tub portion including first and second sloping end walls, first and second sloping sidewalls and a floor region sloping from one of the first and second sloping end walls towards a drain installed in the floor region proximate the other of the first and second sloping end walls. The tub portion includes a plurality of reinforcing metal rods precast into at least the first and second sloping sidewalls and the first and second sloping end walls. The first and second sloping sidewalls and the first and second sloping end walls preferably include an interior surface having an indentation having a thickness configured to match a thickness of a tile. The first and second sloping sidewalls and the first and second sloping end walls include an exterior surface on which is provided a design.

At least one of the first and second sloping end walls includes a connection member, disposed on one of an interior surface or an exterior surface of the at least one of the first and second sloping end walls. The connection member is configured to be connected to a head pillow, for providing a headrest for a user utilizing the outdoor garden tub. At least one of the first and second sloping end walls and first and second sloping sidewalls includes a first portion of at least one of an electrical conduit and a plumbing conduit.

The garden tub according to the invention further includes at least four outdoor garden tub legs, disposed at each of four corners of the precast tub portion. The at least four outdoor garden tub legs include a decorative exterior surface, and wherein at least one of the at least four outdoor garden tub legs include a second portion of the electrical conduit configured for receiving one or more electrical wires coupled to a source of light in the tub portion and a passageway through which may be inserted a ground bonding wire. The ground bonding wire is coupled to the plurality of reinforcing metal rods precast into the first and second sloping sidewalls and the first and second sloping end walls. At least one of the at least four outdoor garden tub legs include a second portion of the plumbing conduit configured for coupling to one or more of a water heater and water pump.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
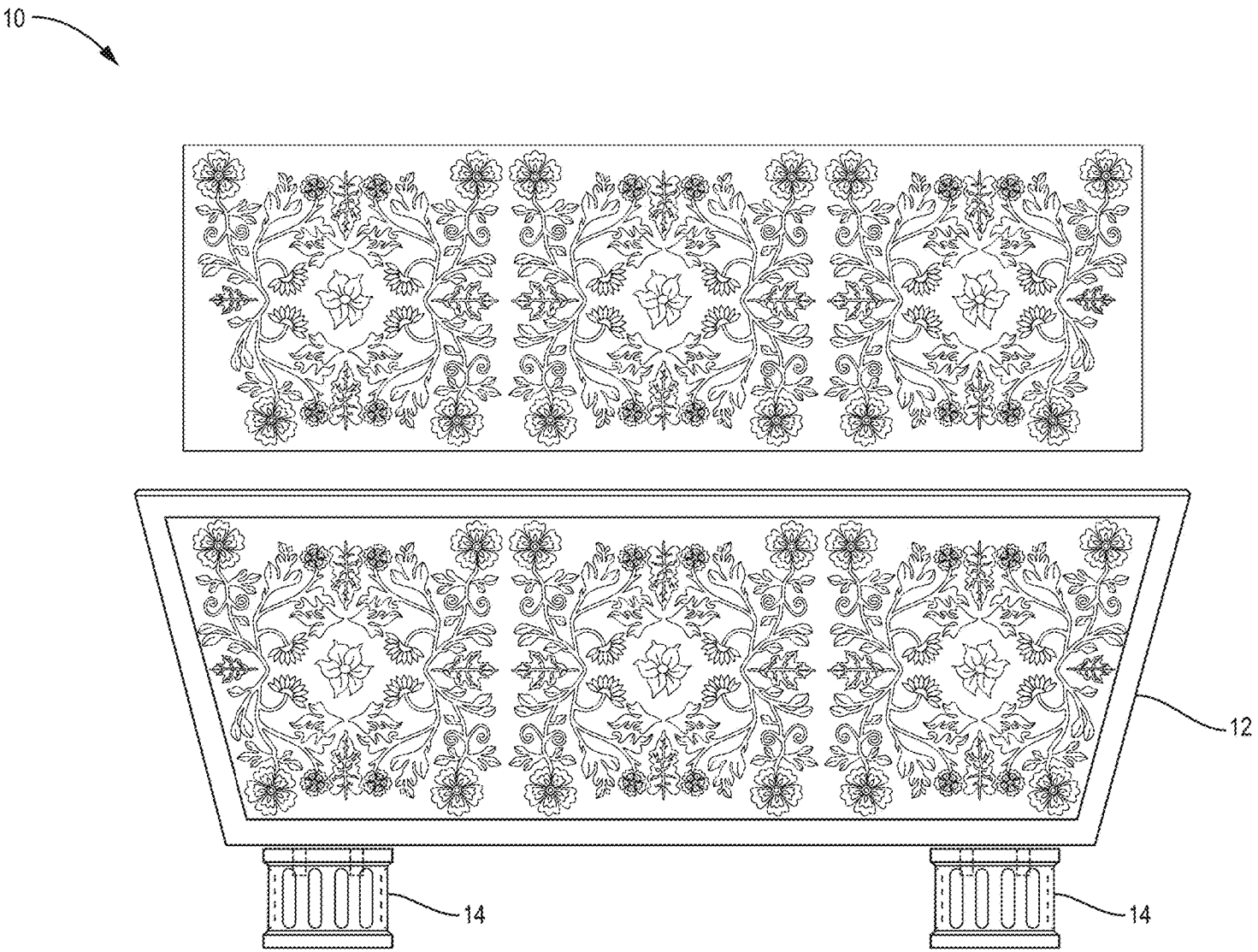
FIG. 1 is a side prospective view of the outdoor garden tub according to one embodiment of the present invention.
Figure 2:
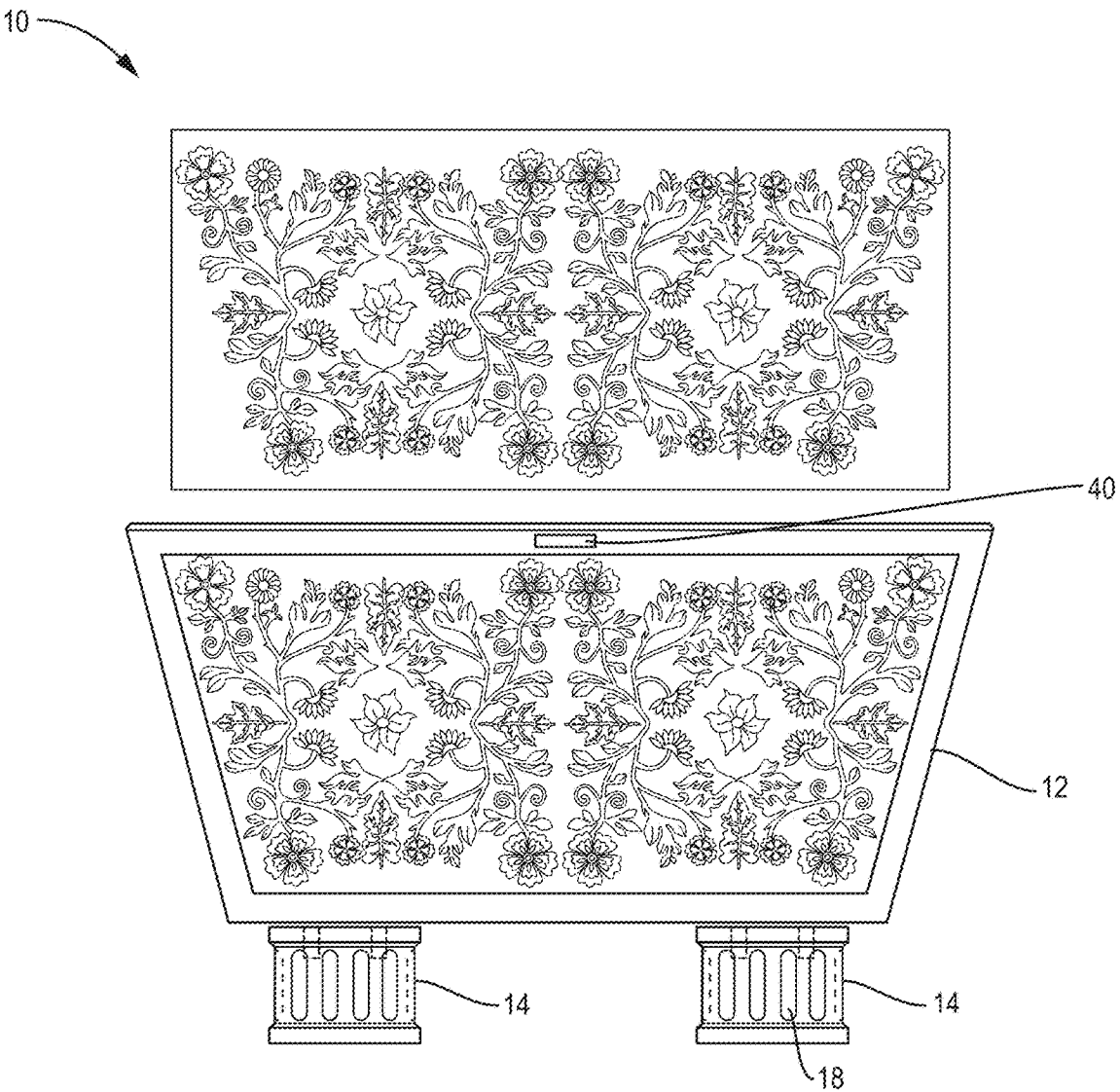
FIG. 2 is an end perspective view of the outdoor garden tub according to one embodiment of the present invention.

The present invention features an outdoor soaking tub 10, FIGS. 1 and 2. The outdoor soaking tub 10 includes a tub portion 12 which is used to hold water. In the preferred embodiment, the tub 12 is supported by four (4) feet 14 which serve to support and elevate the outdoor soaking tub 10 as well as to provide an interior space through which electrical wiring and/or plumbing may be provided, as will be described in greater detail below.

In the preferred embodiment, the outdoor soaking tub 10 is manufactured in the form of a single, monolithic precast concrete tub portion 12 and preferably includes an exterior region of the tub portion 12 including a decorative design 16 that is molded into the concrete when the tub portion 12 is cast. Alternatively, the decorative design 16 may be applied after the tub portion 12 is cast by one or more methods well known to those skilled in the art utilizing paint, etching or other decorative methodology. In the preferred embodiment, the feet 14 also include a decorative design 18 and are precast preferably separately from the tub 12.

Figure 3:
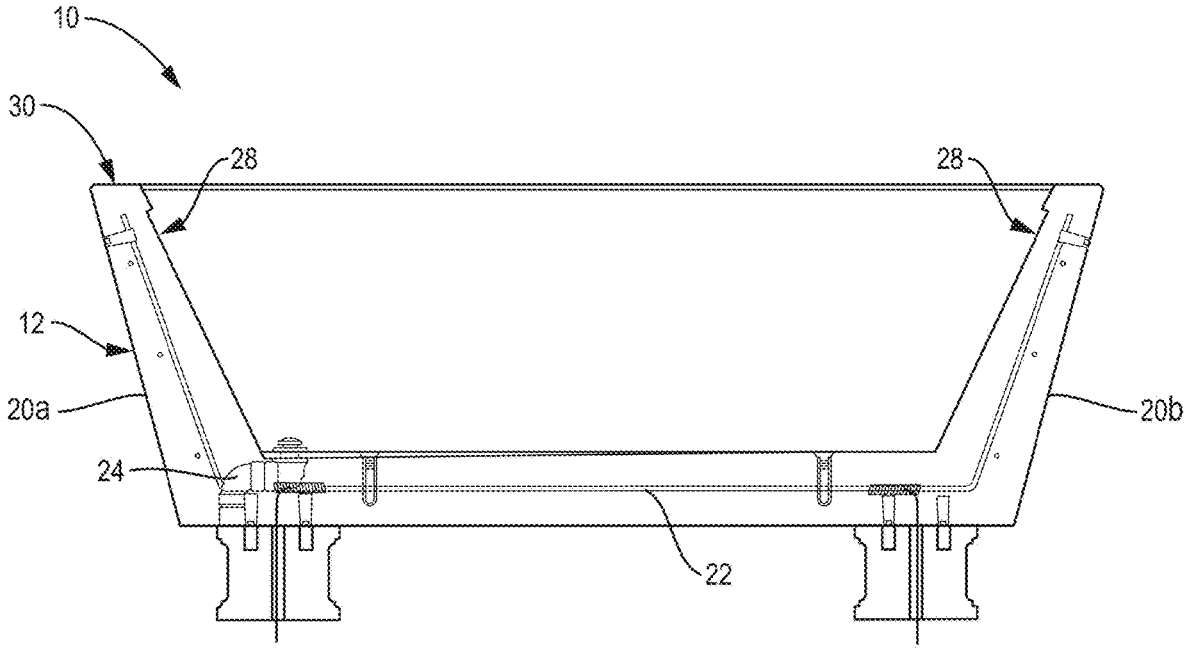
FIG. 3 is a side schematic view illustrating plumbing and electrical connections provided in one embodiment of the outdoor soaking tub according to the present invention.

As shown in cross-section in FIG. 3, the top portion 12 includes slanted end walls 20 walls as well as a slightly sloping floor area 22 that slopes downward towards drain 24.

Figure 4:
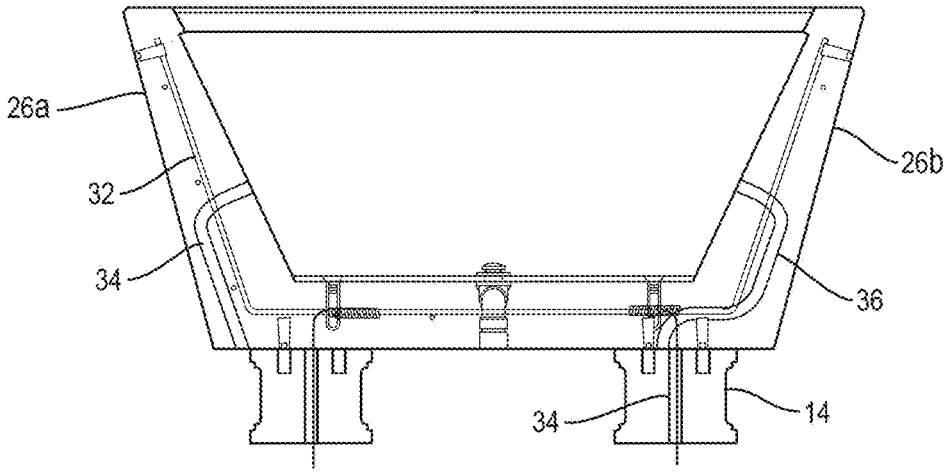
FIG. 4 is an and schematic view illustrating plumbing and electrical connections provided in one embodiment of the outdoor soaking tub according to the present invention.

In the preferred embodiment, the end walls 20 as well as the sidewalls 26, FIG. 4, each preferably include an indentation 28 which provides a recess below the indentation 28 for accepting tiles (not shown) such that the top surface of the tile will be the same thickness as the sidewalls 26 and the end walls 20 above the tiles, thus providing a uniform flat or flush surface on the interior of the top portion 12. The concrete area above the indentation 28 is preferably polished as well as the top edge 30 of the tub 12.

Given that the outdoor garden tub 10 is preferably manufactured from precast concrete, a number of reinforcing bars 32 to are provided in the top portion 12, as is well known in the precast concrete industry. The present invention, however, features a ground bonding wire 34 coupled to the reinforcing bars 30 and which is routed through 1 of the legs 14 for connecting to an electrical ground as is known in the industry. The invention, however, conceals the bonding wire through the foot 14 so that it is not visible nor does it leave the wire exposed. In a similar fashion, and electrical conduit 36 is molded into one or more of the concrete walls 20 or ends 26 and then routed through one or more of the feet 14 so as to provide a conduit through which an electrical connection may be made to a light (not shown) located in one or more side or end walls of the tub portion 12. In this manner, the electrical wires are also enclosed within the tub portion 12 and one or more feet 14 thus preventing them from being damaged or touched or tampered with.

One or more pipes or conduits 34 may be provided in one or more side walls and connected with a pump and/or heater (not shown but well known in the art) to provide heated and/or jetted/circulated water in the tub. The pipe or conduit may exit the tub directly or be routed through one or more feet 14 to hide the pipe connection.

An additional feature of the present invention is shown in FIG. 2 wherein it is shown a hook or other connection member 40 which may be a bar, hook or the like to which may be connected a strap supporting a headrest or pillow (not shown) along one and of the tub member 12. The connection member 40 allows the user to connect a head pillow and allow the head pillow to stay in position and not fall into the tub portion 12 when the user lists his or her head. Other features of the present invention includes one or more lifting hooks which allow the outdoor garden tub 10 to be lifted during the manufacturing process and from a delivery truck to a user's outdoor space. Lifting hooks are well known in the precast concrete industry.

Accordingly, the present invention provides a unique outdoor garden tub that is preferably precast, out of concrete, and designed to have a tiled interior, a pillow or cushion attachment point as well as hidden electrical connections for a light and a ground bonding wire.

As stated above, the present invention is not intended to be limited to a device or method which must satisfy one or more of any stated or implied objects or features of the invention and should not be limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. A pre-cast concrete outdoor garden tub comprising:

a precast concrete tub portion including first and second sloping end walls, first and second sloping sidewalls and a floor region sloping from one of said first and second sloping end walls towards a drain installed in said floor region proximate the other of said first and second sloping end walls;

said precast concrete tub portion including a plurality of reinforcing metal rods precast into at least said first and second sloping sidewalls and said first and second sloping end walls;

said first and second sloping sidewalls and said first and second sloping end walls including an interior surface having a surface indentation, said surface indentation having a thickness configured to match a thickness of a tile;

wherein said first and second sloping sidewalls and said first and second sloping end walls include an exterior surface on which is provided a decorative design;

wherein at least one of said first and second sloping end walls includes a connection member, disposed on one of an interior surface or an exterior surface of said at least one of said first and second sloping end walls, and wherein said connection member is configured to be connected to a head pillow, for providing a headrest for a user utilizing said outdoor garden tub;

wherein at least one of said first and second sloping end walls and first and second sloping sidewalls includes at least a first portion of an electrical conduit and a plumbing conduit; and at least four outdoor garden tub legs, disposed at each of four corners of said precast concrete tub portion, wherein said at least four outdoor garden tub legs include a decorative exterior surface, and wherein at least one of said at least four outdoor garden tub legs include a second portion of said electrical conduit configured for receiving one or more electrical wires coupled to a source of light in said tub portion and a passageway through which may be inserted a ground bonding wire, said ground bonding wire coupled to said plurality of reinforcing metal rods precast into said first and second sloping sidewalls and said first and second sloping end walls, and wherein at least one of said at least one of said at least four outdoor garden tub legs include a second portion of said plumbing conduit configured for coupling to one or more of a water heater and water pump.

* * * * *